US006698627B2

(12) United States Patent
Garcia et al.

(10) Patent No.: US 6,698,627 B2
(45) Date of Patent: Mar. 2, 2004

(54) FLUID DISPENSER

(75) Inventors: Firmin Garcia, Evreux (FR); Alex Milian, Breteuil sur Iton (FR)

(73) Assignee: Valois S.A.S., Le Neubourg (FR)

( * ) Notice: Subject to any disclaimer, the term of this patent is extended or adjusted under 35 U.S.C. 154(b) by 0 days.

(21) Appl. No.: 10/367,734

(22) Filed: Feb. 19, 2003

(65) Prior Publication Data

US 2003/0155376 A1 Aug. 21, 2003

Related U.S. Application Data

(60) Provisional application No. 60/375,050, filed on Apr. 25, 2002.

(30) Foreign Application Priority Data

Feb. 19, 2002 (FR) ..... 02 02096

(51) Int. Cl.[7] ..... B67D 37/00
(52) U.S. Cl. ..... 222/209; 222/94
(58) Field of Search ..... 222/92–107, 214, 222/209

(56) References Cited

U.S. PATENT DOCUMENTS 3,868,036 A * 2/1975 Wittwer ..... 215/12.1
4,020,978 A * 5/1977 Szczepanski ..... 222/209
4,798,311 A 1/1989 Workum
5,108,007 A 4/1992 Smith et al.
5,275,311 A 1/1994 Piarrat
5,388,727 A * 2/1995 Jouillat ..... 222/94
5,564,596 A 10/1996 Meadows et al.
5,579,945 A * 12/1996 Ichikawa et al. ..... 220/495.06
6,142,344 A * 11/2000 Kai ..... 222/183

FOREIGN PATENT DOCUMENTS

JP 406064671 A * 3/1994 ..... 222/95
WO WO 94/16960 * 4/1994 ..... B65D/35/28

* cited by examiner

*Primary Examiner*—Gene Mancene
*Assistant Examiner*—Melvin A. Cartagena
(74) *Attorney, Agent, or Firm*—Sughrue Mion, PLLC

(57) ABSTRACT

A fluid dispenser comprising a dispensing member (1, 2) and packaging (4) surrounding said dispensing member at least in part, said dispensing member (1, 2) comprising a fluid reservoir (1) defining a neck (11) and at least one deformable actuating wall (10) serving to be pushed in to reduce the internal volume of the reservoir, said dispensing member (1) being provided with a dispensing orifice (25) through which the fluid is delivered by pressing on the actuating wall (10) of the reservoir (1), said packaging (4) having at least one deformable face (41) situated facing the actuating wall (10) of the reservoir, so that the actuating wall can be pushed in via the deformable face of the packaging, said fluid dispenser being characterized in that the packaging (4) is connected to the dispensing member (1, 2) at a fixing appendage (21) that is secured to or integral with the dispensing member and that has a fixing zone (210) for fixing to the packaging (4).

18 Claims, 3 Drawing Sheets

FLUID DISPENSER

CROSS REFERENCE TO RELATED APPLICATION

This application claims the benefit under 35 U.S.C. §119 (e) of pending U.S. provisional patent application Ser. No. 60/375,050, filed Apr. 25, 2002, and priority under 35 U.S.C. §119(a)–(d) of French patent application No. FR-02.02096, filed Feb. 19, 2002.

TECHNICAL FIELD

The present invention relates to a fluid dispenser comprising a dispensing member and packaging surrounding said dispensing member at least in part. The dispensing member comprises a fluid reservoir defining a deformable actuating wall that can be pushed in by using a finger to reduce the internal volume of the reservoir and thus to deliver some of the fluid stored inside the reservoir through a dispensing orifice. Such dispensing members are in frequent use in the field of perfumes, or indeed cosmetics and pharmaceuticals.

BACKGROUND OF THE INVENTION

In the prior art, mention may be made, for example, of Documents FR-2 778 639, FR-2 781 770, FR-2 791 645, or FR-2 796 368. All of those documents describe dispensing members forming reservoirs containing fluid and air. To dispense the fluid, a deformable face of the reservoir is pressed in so that a mixture of fluid and of air is delivered through a dispensing orifice in the form of a two-phase spray. In Document FR-2 796 368, the dispensing member is provided with trim that is in the form of a packaging jacket that covers the deformable face of the reservoir at least in part. That packaging jacket is fixed to the dispensing member over the rear face thereof, i.e. over its face opposite from the deformable face. It can also be noted that that reservoir is made up of a shell that is advantageously thermoformed and that forms the deformable actuating face. That shell is closed by a sealing film which is connected to the shell over the plane periphery thereof. For the same type of packaged dispensing member, mention may be made of Document FR-2 784 361 which describes a dispensing member provided with a flap that extends over the deformable actuating face. That flap is fixed either onto the edge of the shell or onto the edge of the sealing film that closes it. In that Document as well, the reservoir is made up of a shell and of a sealing film. In the preceding two documents, it is easy to fix the packaging to the dispensing member because said dispensing member forms one or more plane surfaces that facilitate fixing.

It is an entirely different matter when the dispensing members do not have such plane surfaces suitable for fixing. An object of the present invention is to remedy the above-mentioned drawbacks of the prior art, which drawbacks are related to the specific structure of the dispensing member (shell+film), while also associating very attractive packaging with it. Therefore, an object of the present invention is to provide a dispenser formed of a dispensing member and of packaging, and whose dispensing member is in a more conventional form with a preferably one-piece reservoir forming a neck at which the dispensing orifice is provided.

BRIEF SUMMARY OF THE INVENTION

To this end, the present invention provides a fluid dispenser comprising a dispensing member and packaging surrounding said dispensing member at least in part, said dispensing member comprising a fluid reservoir defining a neck and at least one deformable actuating wall serving to be pushed in to reduce the internal volume of the reservoir, said dispensing member being provided with a dispensing orifice through which the fluid is delivered by pressing on the actuating wall of the reservoir, said packaging having at least one deformable face situated facing the actuating wall of the reservoir, so that the actuating wall can be pushed in via the deformable face of the packaging, said fluid dispenser being characterized in that the packaging is connected to the dispensing member at a fixing appendage that is secured to or integral with the dispensing member and that has a fixing zone for fixing to the packaging. Advantageously, the fixing appendage is situated in the vicinity of the neck of the reservoir. In an embodiment, the fixing appendage is made integrally with the dispensing member. In a variant, the fixing appendage is separate and mounted on the dispensing member.

In a more practical embodiment, the dispensing member further comprises a dispensing end-piece forming the dispensing orifice and mounted in or around the neck of the reservoir, the fixing appendage being secured to or integral with the end-piece.

In any event, the fixing appendage may have an outer peripheral outline that defines the fixing zone for fixing to the packaging. Advantageously, the fixing zone is cylindrical, with a diamond-shaped or eye-shaped cross-section.

As regards the packaging, it may have two faces connected together along their side edges and connected to the fixing appendage along their top edges, their bottom edges advantageously defining an open bottom. In practical manner, the packaging may be made up of two separate sheets of elastically deformable material, or of one sheet of elastically deformable material folded in half.

For example, the reservoir of the dispensing member may be in the form of a flask or of a small bottle having a deformable wall, e.g. made of soft thermoplastic. A standard end-piece may then be mounted on the deformable bottle. One advantage of the present invention is that it enables a fixing appendage of any shape to be mounted on the standard end-piece. In this manner, it is possible to produce a standard dispensing member and to equip it subsequently with a fixing appendage of desired design. It should be noted that the packaging can be fixed to the fixing appendage merely by sealing or even by adhesive.

BRIEF DESCRIPTION OF THE DRAWINGS

The invention is described more fully below with reference to the accompanying drawings which give two embodiments of the present invention by way of non-limiting example.

In the figures.

PREFERRED EMBODIMENT OF THE INVENTION

Figure 1:
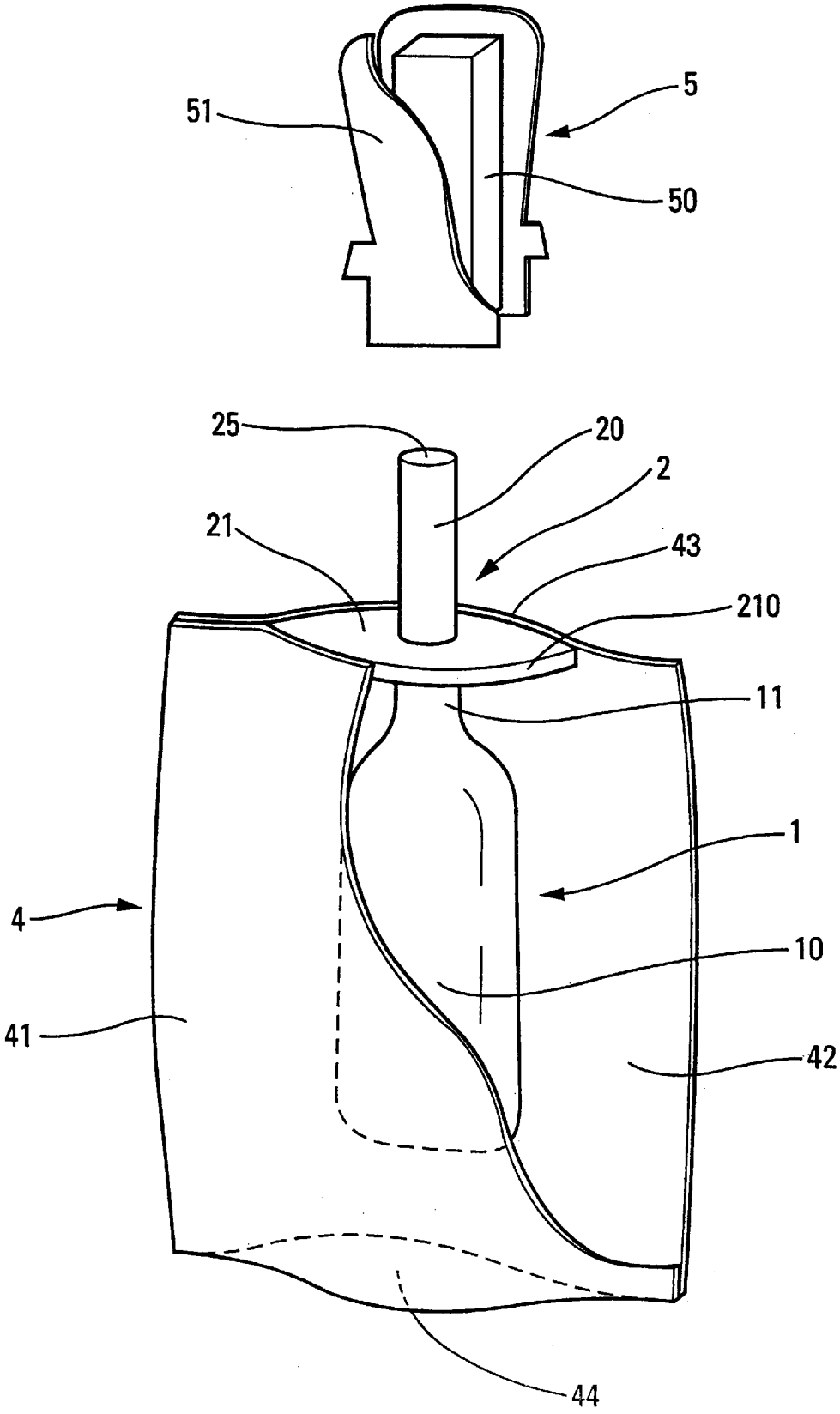
FIG. 1 is a partially cut-away diagrammatic perspective view of a fluid dispenser of the invention.
Figure 2:
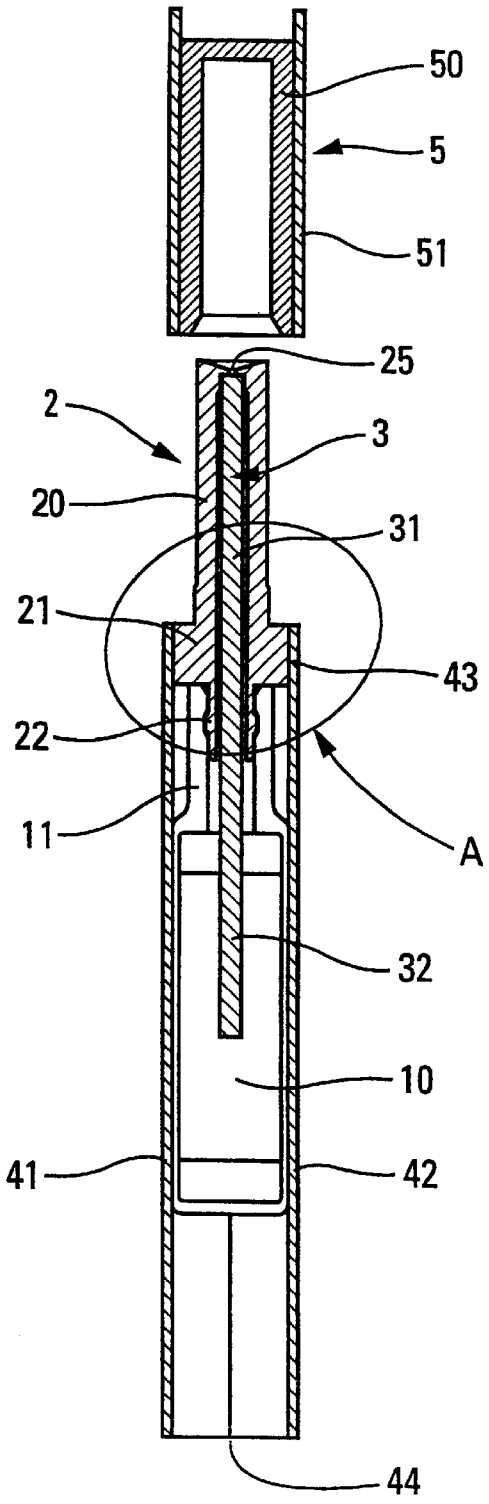
FIG. 2 is a vertical section view of the dispenser of FIG. 1.
Figure 3:
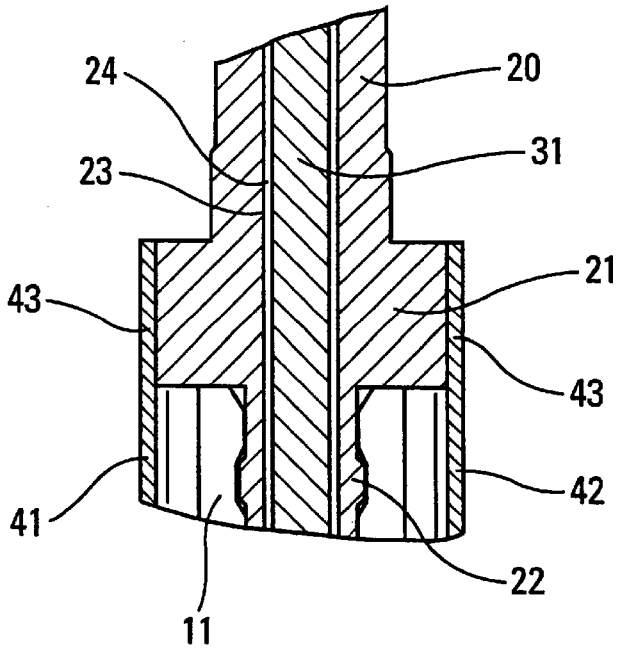
FIG. 3 is an enlarged view of detail A of FIG. 2.

The dispenser of the invention comprises two essential component parts, namely a dispensing member formed by a reservoir 1 and by a dispensing end-piece 2, and packaging 4 surrounding the dispensing member at least in part. Preferably, the dispenser is further provided with a cap or stopper 5 which covers the dispensing end-piece 2 so as to close off the dispensing orifice of the dispenser.

The dispensing member thus includes a reservoir 1 forming at least one deformable actuating wall 10 and a neck 11, so that the reservoir 10 is conventionally in the form of a small flask or bottle. For example, the reservoir 10 may be made of a plastics material whose wall thickness is larger at the neck 11 than at the level of the deformable actuating wall 10. The dispensing end-piece 2 is mounted in or on the neck 11 by establishing leaktight fixing therebetween. In the embodiments shown in FIGS. 2 to 5, the dispensing end-piece 2 includes a fixing sleeve 22 that co-operates with the inside wall of the neck 11. It is also possible to use a fixing sleeve that co-operates with the outside wall of the neck 11. At its end opposite from the fixing sleeve 22, the dispensing end-piece 2 forms a dispensing orifice 25. An internal recess 23 is formed inside the dispensing end-piece 2 and extends from the fixing sleeve 22 to the dispensing orifice 25. The internal recess 23 receives a sort of rod 3 that is made of a porous material that is capable of absorbing fluid by capillary action. The piece of porous material 3 comprises a portion that is received and fixed inside the dispensing end-piece 2, and an external portion 32 that extends inside the reservoir through the neck 10. Thus, the piece of porous material 3 can be imbibed with fluid that it collects from the reservoir 1. The piece of porous material 3 is thus received inside the internal recess 23 formed by the dispensing end-piece 2, but said recess 23 also forms longitudinal channels 24 that extend over the entire height of the internal portion 31 of the piece of porous material 3. These channels 24 make it possible for air to reach the dispensing orifice 25, so that a mixture of air and of fluid reaches the dispensing orifice 25. Thus, by pressing on the deformable actuating wall 10 of the reservoir 1, fluid stored in the piece of porous material 3 and also air coming from the channels 24 reaches the dispensing orifice 25 where it is dispensed in the form of a two-phase spray. After each occasion on which the actuating wall 10 is pushed in, said actuating wall returns to its initial rest shape. This is made possible by the fact that the actuating wall has resilience or shape memory resulting in air being sucked into the reservoir 1 through the dispensing orifice 25. In this way, there is always air inside the reservoir 1. Two-phase dispensing is thus possible until there is no more fluid stored in the reservoir and in the piece of porous material 3.

Advantageously, the dispensing end-piece 2 may be capped with a cap 5 that may be in the form of a body 50 covered with trim 51. The cap 50 serves to protect the end-piece 2 and to close off the dispensing orifice 25.

In the invention, the dispensing member is provided with a fixing appendage 21 or 21' to which the packaging 4 is fixed. The fixing appendage may be integral with the dispensing member, i.e. with the reservoir 1 or with the dispensing end-piece 2. In a variant, the fixing appendage may be separate and mounted on the dispensing member, and be held in place thereon by clamping, snap-fastening, or adhesive, or by any other well-known fixing technique. The fixing appendage is located outside the neck.

In the preferred embodiment, the fixing appendage is secured to or integral with the dispensing end-piece 2. In the embodiment shown in FIGS. 2 and 3, the fixing appendage 21 is made integrally with the dispensing end-piece. The fixing appendage 21 is situated just above the top end of the neck 11 of the reservoir 10. It is also possible to imagine that the fixing appendage 21 extends around the neck 11. In the alternative embodiment shown in FIGS. 4 and 5, the fixing appendage 21' is in the form of a separate part fixed to the dispensing end-piece 2, substantially at the same level as in FIGS. 2 and 3. By being separate and mounted on the dispensing end-piece 2, the fixing appendage 21' makes greater modularity possible because it is very easy to replace the dispensing appendage 21 with another appendage having a different shape. It is thus possible to implement a standard dispensing end-piece to which fixing appendages of different shapes can be fitted.

With reference once again to FIG. 1, it can be seen that the fixing appendage 21 extends around the dispensing end-piece 2. It is diamond-shaped or shaped like an eye in which the dispensing end-piece 2 is the pupil or iris. The outer peripheral outline of the fixing appendage 21 is provided with a cylindrical edge 210 which defines the fixing zone to which the packaging 4 is fixed. The diamond or eye shape is particularly advantageous because it makes it possible for the packaging to be closed off in uninterrupted manner either onto itself or onto the fixing appendage 21.

The packaging 4 may be in the form of a jacket closed along its vertical side edges. In the embodiment shown in FIG. 1, the packaging 4 is made up of two deformable flexible sheets 41 and 42 secured together along their vertical sides edges and fixed onto the fixing zone 210 of the fixing appendage 21. Advantageously, the bottom edges of the sheets 41 and 42 may remain apart so as to form an open bottom 44. Thus the packaging 4 is fixed to the appendage 21 at the top end 43 of the packaging. Naturally, it is possible to imagine other embodiments for the packaging 4. For example, it is possible to implement it with an exactly cylindrical shape by providing a fixing appendage 21 that has a circularly cylindrical fixing peripheral edge.

The fixing appendage 21 or 21' of the present invention acts as an intermediate piece between the dispensing member and the packaging 4, and makes it possible for any packaging to be fixed very easily and in modular manner to a standard dispensing member. It also constitutes a closure element for closing off the packaging at its top end.

To actuate such a dispenser, it is necessary merely to push in one or both of the sheets 41 and 42 of the packaging 4 so as to flatten between them the reservoir 1 or more precisely the actuating walls 10 thereof.

One of the advantageous characteristics of the invention lies in the fact that a fixing appendage connected to the dispensing member has a cylindrical fixing zone making it possible to fit packaging that is cylindrical but not necessarily circularly cylindrical in overall shape.

According to another feature of the invention, which is present in all the embodiments represented on the Figures, the packaging 4 is in contact with the reservoir over a part of its height and periphery. Preferably, the reservoir has a horizontal cross section with a shape similar, approaching or identical to the diamond or eye shape of the fixing appendage. The packaging has therefore a better strength. Advantageously, the package is attached to the reservoir by welding or adhesive.

Figure 4:
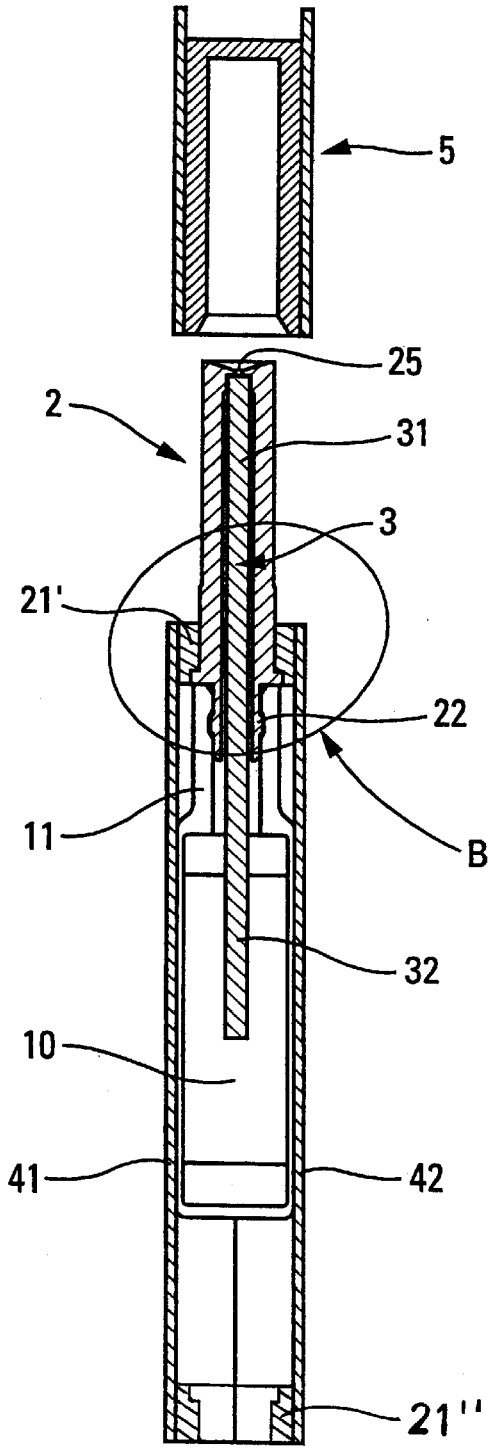
FIG. 4 is a vertical section view through a variant embodiment of FIG. 2.
Figure 5:
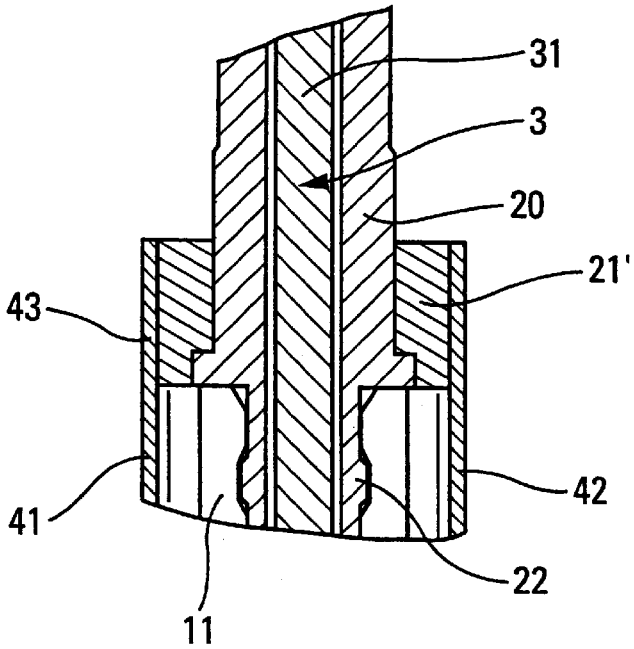
FIG. 5 is an enlarged view of detail B of FIG. 4.

According to another aspect of the invention, represented in FIG. 4, the lower end of the packaging is provided with a bottom appendage 21" which at least partially seals the packaging. This appendage 21" may be quite identical to the fixing appendage 21'. It is to be noticed that the reservoir is aligned with both appendages 21' and 21". So, the packaging has a very good strength with a cylindrical shape.

What is claimed is:

1. A fluid dispenser comprising a dispensing member (1, 2) and packaging (4) surrounding said dispensing member at least in part, said dispensing member (1, 2) comprising a fluid reservoir (1) defining a neck (11) and at least one deformable actuating wall (10) serving to be pushed in to reduce the internal volume of the reservoir, said dispensing member (1) being provided with a dispensing orifice (25) through which the fluid is delivered by pressing on the actuating wall (10) of the reservoir (1), said packaging (4) having at least one deformable face (41) situated facing the actuating wall (10) of the reservoir, so that the actuating wall can be pushed in via the deformable face of the packaging, the packaging (4) being connected to the dispensing member (1, 2) at a fixing appendage (21) that is secured to or integral with the dispensing member and that has a fixing zone (210) for fixing to the package (4), the dispensing member comprising a dispensing end-piece (2) forming the dispensing orifice (25) and a fixing sleeve (22) mounted in or around the neck (11) of the reservoir (1), the fixing appendage (21) being secured to or integral with the end-piece (2) and located above the fixing sleeve, between the sleeve and the orifice.

2. A dispenser according to claim 1, in which the fixing zone (210) is cylindrical, with a diamond-shaped or eye-shaped cross-section.

3. A dispenser according to claim 1, in which the reservoir has a horizontal cross section with a shape substantially identical to the shape of the fixing appendage.

4. The dispenser according to claim 1, in which the packaging is substantially cylindrical with an upper edge and a lower edge having substantially the same cross-sectional shape.

5. The dispenser according to claim 1, wherein the fixing appendage (21) is a continuous integral one-piece construction with the end-piece (2).

6. The dispenser according to claim 1, wherein the end-piece has a narrow portion (20) that extends towards the orifice and away from fixing appendage (21), wherein the fixing appendage (21) extends radially and outwardly away from the narrow portion (20) to form a flange, and wherein the packaging (4) is secured to an edge of the flange.

7. The dispenser according to claim 6, further comprising a porous member (31) that extends in the narrow portion (20) and that defines longitudinal channels within the narrow portion.

8. The dispenser according to claim 1, wherein the fixing sleeve is snap-fit to the neck of the reservoir.

9. A fluid dispenser comprising a dispensing member (1, 2) and packaging (4) surrounding said dispensing member at least in part, said dispensing member (1, 2) comprising a fluid reservoir (1) defining a neck (11) and at least one deformable actuating wall (10) serving to be pushed in to reduce the internal volume of the reservoir, said dispensing member (1) being provided with a dispensing orifice (25) through which the fluid is delivered by pressing on the actuating wall (10) of the reservoir (1), said packaging (4) having at least one deformable face (41) situated facing the actuating wall (10) of the reservoir, so that the actuating wall can be pushed in via the deformable face of the packaging, the packaging (4) being connected to the dispensing member (1, 2) at a fixing appendage (21) that is secured to or integral with the dispensing member and that has a fixing zone (210) for fixing to the packaging (4); the packaging (4) having two faces (41, 42) connected together along their side edges and connected to the fixing appendage along their top edges (43), their bottom edges advantageously defining an open bottom (44).

10. A dispenser according to claim 9, in which the fixing appendage (21) is situated in the vicinity of the neck (11) of the reservoir (1).

11. A dispenser according to claim 9, in which the fixing appendage (21) is made integrally with the dispensing member (1, 2).

12. A dispenser according to claim 9, in which the fixing appendage (21) is separate and mounted on the dispensing member (1, 2).

13. A dispenser according to claim 9, in which the packaging (4) is made up of two separate sheets of elastically deformable material, or of one sheet of elastically deformable material in half.

14. A dispenser according to claim 9, in which the packaging extends in contact with the reservoir.

15. A dispenser according to claim 9, in which the packaging is attached to the reservoir over a part of its height and periphery.

16. The dispenser according to claim 9, in which the reservoir has a horizontal cross section with a shape substantially identical to the shape of the fixing appendage.

17. The dispenser according to claim 9, in which the packaging is substantially cylindrical with an upper edge and a lower edge having substantially the same cross-sectional shape.

18. A fluid dispenser comprising a dispensing member (1, 2) and packaging (4) surrounding said dispensing member at least in part, said dispensing member (1, 2) comprising a fluid reservoir (1) defining a neck (11) and at least one deformable actuating wall (10) serving to be pushed in to reduce the internal volume of the reservoir, said dispensing member (1) being provided with a dispensing orifice (25) through which the fluid is delivered by pressing on the actuating wall (10) of the reservoir (1), said packaging (4) having at least one deformable face (41) situated facing the actuating wall (10) of the reservoir, so that the actuating wall can be pushed in via the deformable face of the packaging, the packaging (4) being connected to the dispensing member (1, 2) at a fixing appendage (21) that is secured to or integral with the dispensing member and that has a fixing zone (210) for fixing to the packaging (4); and wherein the packaging is provided with a bottom appendage (21") having advantageously a shape substantially identical to the shape of the fixing appendage.

* * * * *